United States Patent [19]

Moore et al.

[11] Patent Number: 4,490,172

[45] Date of Patent: Dec. 25, 1984

[54] METHOD OF MELTING AND REFINING STEEL AND OTHER FERROUS ALLOYS

[76] Inventors: William H. Moore, Whitehall Apts.-6E, Whitehall Rd., Chattanooga, Tenn. 37405; Harry H. Kessler, No. 7 Dromara Rd., St. Louis, Mo. 63124

[21] Appl. No.: 456,827

[22] Filed: Jan. 10, 1983

Related U.S. Application Data

[63] Continuation of Ser. No. 199,958, Oct. 23, 1980, , which is a continuation of Ser. No. 53,700, Jun. 29, 1979.

[51] Int. Cl.[3] ..... C21C 7/02

[52] U.S. Cl. ..... 75/58; 75/53; 75/59; 75/60

[58] Field of Search ..... 75/58, 59, 53, 60

[56] References Cited

U.S. PATENT DOCUMENTS

| | | | |
|---|---|---|---|
| 3,598,383 | 8/1971 | Moore | 75/53 |
| 3,598,573 | 8/1971 | Trostberg | 75/53 |
| 3,640,702 | 2/1972 | Karinthi | 75/53 |
| 3,861,888 | 1/1975 | Heise | 75/60 |
| 3,932,172 | 1/1976 | Knuppel | 75/59 |

FOREIGN PATENT DOCUMENTS

| | | | |
|---|---|---|---|
| 1258451 | 12/1971 | United Kingdom | 75/53 |

*Primary Examiner*—Peter D. Rosenberg
*Attorney, Agent, or Firm*—Woodling, Krost, Rust & Hochberg

[57] ABSTRACT

Our invention is an improved process for removing gases and elements from a melt of molten ferrous metal; the process includes bubbling carbon dioxide through the melt, flushing the carbon dioxide from the melt with an inert gas and deoxidizing the melt with a metal chosen from the group of aluminum, magnesium, barium, calcium, zirconium or titanium.

11 Claims, 4 Drawing Figures

METHOD OF MELTING AND REFINING STEEL AND OTHER FERROUS ALLOYS

This is a continuation of application Ser. No. 199,958, filed Oct. 23, 1980, which is a continuation of Ser. No. 53,700 filed June 29, 1979.

Our invention relates to a method of refining steel that is low in gas content and exceptionally clean; the steel having a high order of physical properties without the necessity of introducing oxygen with all of its attendant problems into the steel.

An object of our invention is to provide a steel of decreased inclusion count and improved physical properties.

Our invention facilitates "back charging" induction furnaces thereby increasing their efficiency.

A further object is to provide a method of producing a steel in low and medium frequency induction and arc furnaces without problems associated with the gas content of the metal.

Our invention precludes "wild" metal. The molten metal can be poured without the formation of gas holes or the necessity of introducing large quantities of a deoxidizing agent to remove the gas hole potential of the molten metal.

A still further object is to improve the economy of refining steel by limiting losses of silicon and manganese during the oxidation period of melting.

Only relatively small amounts of slag are produced.

Other objects and a fuller understanding of this invention may be had by referring to the following description and claims taken in conjunction with the accompanying drawings in which:

In the manufacture of steel it is important to remove all of the gases contained by the raw material and to obtain the right percentage of constituent elements.

To control the proportions of these gases and elements, and particularly carbon and oxygen, various techniques have been developed.

Figure 1:
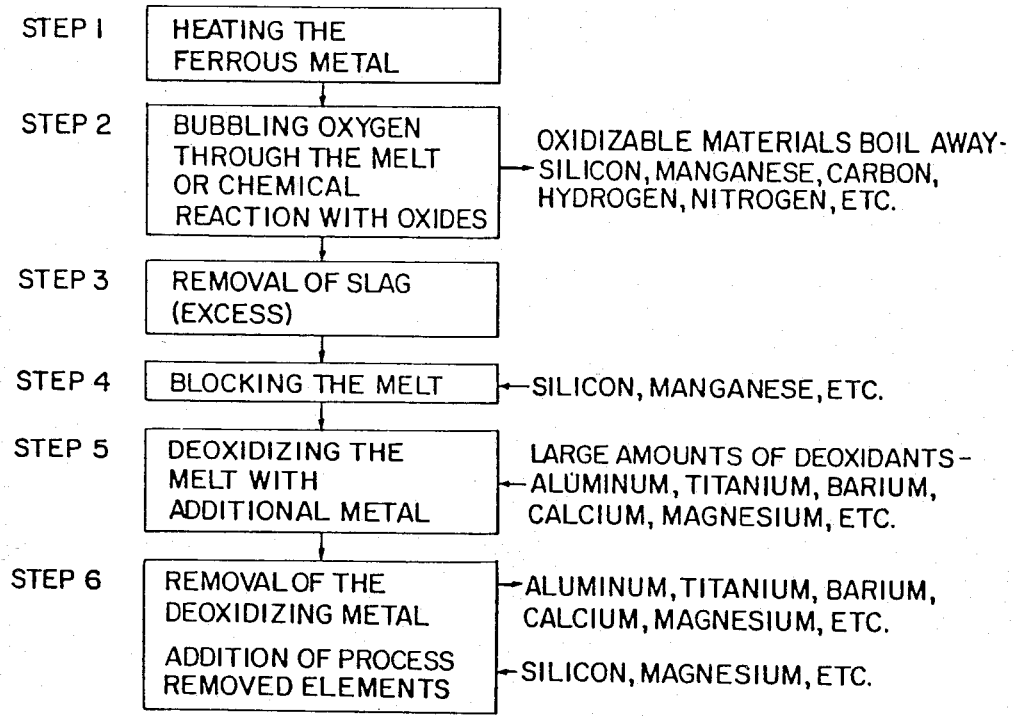
FIG. 1 is a block description of the current oxygen bubbling method of removing carbon from a melt of molten ferrous metal.

FIG. 1 demonstrates in graphic form the technique our improvement is adapted from.

In this technique the ferrous metal to be processed contains an excess quantity of carbon over that desired in the final product.

The metal is then heated (Step 1). The usual practice is to promote an active boil in the heated molten metal (melt) designed to remove the undesired gases and elements from the ferrous metal. It is seldom that a "melt" is made without movement within the bath, for, to make such a melt successfully, the ferrous metal so processed must be completely free of oxides such as rust, which contain water, and the atmosphere above the melt must be kept purged of moisture laden air to avoid hydrogen or nitrogen pickup.

This boil is produced in this technique by the injection of gaseous oxygen into the melt or by natural reaction between oxides and carbon (Step 2). The oxygen is supposed to react with the carbon in the bath to produce carbon monoxide gas. This reduces the amount of carbon in the melt and provides an important index of the quality and measure of the steel making process.

The carbon monoxide gas produced causes a boiling action in the melt designed to remove other unwanted gases and elements (such as nitrogen and hydrogen). Unfortunately the oxygen injected acts immediately to oxidize or burn out the silicon, manganese and other important desired elements before it begins to react with the carbon in the melt to produce the carbon monoxide necessary for the boil.

This produces large copious quantities of slag which must be removed (Step 3). The bath must also be "blocked" by the addition of manganese, silicon or similar material (Step 4).

It also produces a high degree of oxidation in the melt. Not only is any oxidation itself harmful to steel but also this causes a "wild" melt. A "wild" melt cannot be poured as such because the poured shape would contain large gas holes. A large quantity of a deoxidizing metal (aluminum, calcium, etc.) must be added to the melt to remove this problem (Step 5). These deoxidizing metals must be removed at a later step or these inclusions, depending upon their size, shape and amount, can exert a harmful effect on the physical properties of the steel, particularly the impact valve (Step 6).

The oxygen boil also forms a very large amount of iron oxide which pollutes the atmosphere above the furnace. This and other oxides also contaminate the melt itself in large quantities.

A large problem with the oxygen boil technique deals with the efficiency of operation of an induction furnace vs. the method of operation of the technique.

In producing ferrous metal in a low frequency induction furnace where starting from a cold charge is extremely time-consuming, it is customary to use a large metal starting block for starting up and it is then customary to keep power on around the clock so that the furnace always contains molten metal. When molten metal is drawn from the furnace, it is replaced by solid charge material. This process is known as "back charging" which avoids the necessity of starting the furnace from a cold condition with a complete charge of solid metal.

In attempting to produce steel by the process of back charging, it, of course, is impossible to boil the bath by conventional means because all elements such as silicon and manganese would be removed before the effective boil commences. This would have to be repeated for each subsequent charge that would be added as a "back charge". This would create large quantities of slag. Normal "blocking" of the charge by adding replacement silicon and metal on each occasion would increase the cost of making steel using this "back charging" procedure.

Avoiding a boil would result in a metal containing large amounts of hydrogen and nitrogen gas which amount would be increased by each new charge of material added to the molten metal left in the furnace after each tap had been made. These would have to be subsequently removed.

In commercial practice attempts are frequently made to avoid a boil because of the physical problems that exist where boiling is used—particularly the necessity of scouring the lining to avoid the buildup of residues.

There is no satisfactory solution or compromise to these problems while using this technique.

Figure 2:
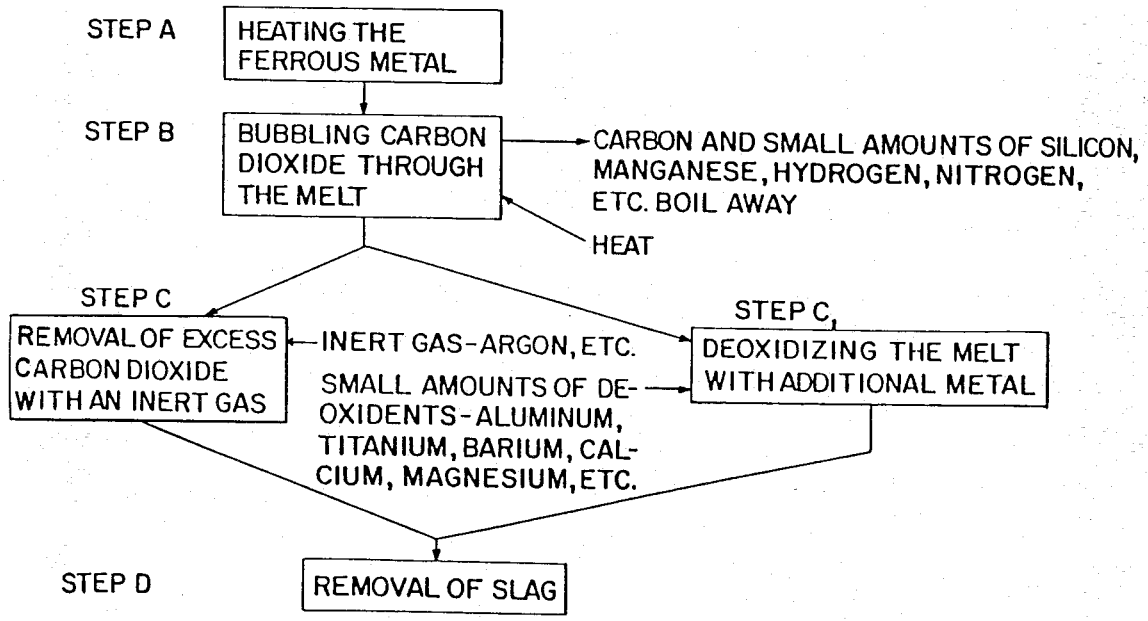
FIG. 2 is a block description of our inventive process.

FIG. 2 demonstrates in block form a typical flow chart embodiment of our invention.

The technique also begins with a ferrous metal having a higher carbon content than desired being heated into a melt (Step A).

However, in contrast to the oxygen boil technique, our invention produces a boil with carbon dioxide gas (Step B). This technique completely removes unwanted gases and elements while solving most of the otherwise accompanying problems of the boil technique.

Carbon dioxide reacts with carbon according to the formula $CO_2+C \rightleftarrows 2CO$. Since this reaction proceeds in the forward direction, $CO_2+C \rightarrow 2CO$, at a considerably faster rate at a higher temperature, it is preferable to heat the melt during the boil.

Since carbon dioxide does not react to any marked degree with silicon, manganese, etc. these important elements are not oxidized out of the melt. This reduces markedly the quantity of slag that is produced by the steel making process (Step D).

The carbon dioxide itself does not appreciably oxidize the melt. This lowers the iron oxide production during the boiling process; the steel mill is cleaner.

It also lowers the potential of a "wild" melt so that in addition a lesser quantity of deoxidizing metal need be used in the melt (Step C); this is normally to the degree of removing any necessity of a separate manufacturing step to remove it.

In the alternative any excess carbon dioxide gas and oxides can also be removed from the melt by bubbling an inert gas such as argon through the steel (Step $C_1$), thereby avoiding any additional metal contamination altogether.

The bubbling of the carbon dioxide gas through a melt, particularly when the melt is being heated, gives a mechanical scrubbing action which removes hydrogen and nitrogen from the melt because of the partial pressure phenomenon which involves diffusion of these gases into bubbles of $CO_2$ artificially produced in the melt.

The carbon monoxide produced by the $CO_2+C \rightarrow 2CO$ reaction would, just as in regular boil technique, help remove gases from the melt.

In the process of our invention, we can produce steel readily in induction furnaces still using the very convenient method of "back charging". By flushing the melt with carbon dioxide continuously as each charge increment first becomes molten, all dissolved gases, such as nitrogen and hydrogen, are removed completely and replaced by carbon dioxide gas. This is accomplished without any appreciable loss of oxidizable elements, such as silicon, manganese, chromium and the like, contained in the metallic charge. Whenever a tap is made and molten steel is withdrawn from the furnace, the carbon dioxide left in the metal can be removed conveniently in the ladle by a simple deoxidizing addition of aluminum, calcium, magnesium, titanium, or the like.

Being able to produce steel successfully in these induction furnaces makes it possible to utilize power efficiently and also to produce steel in foundries normally confined to the manufacture of cast iron because of the melting unit used.

The amount of carbon dioxide used in boiling the steel bath is variable according to the quality of steel scrap used and the final content of nitrogen and hydrogen allowable in the steel. We usually use approximately 5 cubic feet per ton per minute for a period of approximately ten minutes. This results in a total consummation of 50 cubic feet per ton of metal. This amount of carbon dioxide will usually result in a lowering of the carbon content by 0.05–0.15%, depending on the original level of carbon in the bath. The carbon removed in higher carbon heats (0.4% or more) is expectedly greater than that removed in lower carbon heats. With rusty scrap in the charge, the amount removed is greater than when the charge is relatively clean. Carbon removal from the bath normally would be expected to be from 5% to 30% of that originally present whereas silicon and manganese would usually remain substantially unchanged.

The molten metal that has been processed with carbon dioxide contains a quantity of carbon dioxide dissolved in the metal. This can be removed by the addition of aluminum, titanium, calcium, barium, zirconium magnesium and the like, either singly or in combination. It is also possible to remove the carbon dioxide by flushing the bath with an inert gas, such as argon, prior to removing it from the furnace. We generally find that metallic aluminum is the most conveient material to use. It combines with carbon dioxide according to the formula $$3CO_2+4Al \rightarrow 2Al_2O_3+3C.$$

This deoxidizing action releases a small quantity of carbon in the metal, but, because of the relatively low amount of carbon dioxide present, is insufficient to measurably alter the final carbon content of the metal.

While we particularly prefer to use the process in the manufacture of steel, we have found that boiling with carbon dioxide in the process of this invention is also beneficial in melting cast irons, white irons, stainless steel, alloyed white irons, and all ferrous metals likely to contain hydrogen and nitrogen gas. In high chromium metals in particular, we find that oxidation of chromium during the melting process can be held to a minimum when utilizing the process of this invention. We feel that the atmosphere of carbon dioxide produced above the bath and the consequent exclusion of air from the metal surface is largely responsible for this beneficial result.

For the injection of carbon dioxide into the melt, we prefer to use a lance arrangement fitted with a porous plug at its lower extremity.

Figure 3:
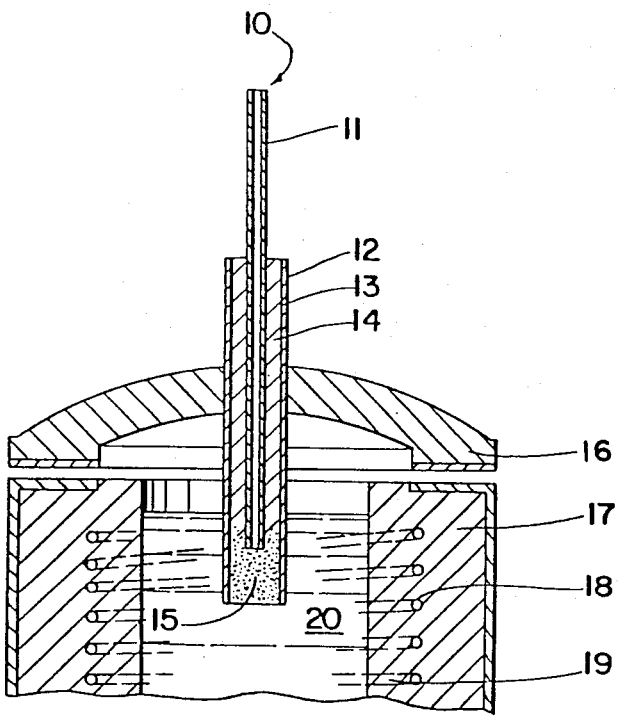
FIG. 3 is a cross-sectional drawing of a typical commercial embodiment of an induction furnace in which our invention is practiced.

FIG. 3 is a cross-sectional drawing of the upper portion of a typical coreless induction furnace typifying a lance usage.

Gas is supplied from an external source 10 into the supply pipe 11. The supply pipe 11 is fitted into the lance 12 and supplies gas to the porous lower end of the lance 12.

The lance 12 is made up of a refractory outer cover 13, refractory cement 14 holding the supply pipe 11 in place and a refractory porous body 15.

The outer cover 13 varies in diameter from about 1" to 6" or more depending on the surface area and volume of the melt 20. The porous body 15 can be conveniently made by ramming a refractory material such as alundum, silica, chromite or zirconite bonded with sodium silicate, boric acid or any other suitable refractory cement. The refractory material should be made of such an aggregate size that it is porous to the passage of carbon dioxide.

The lance 12 itself is connected to the top cover 16 of an induction furnace 17. Coils 18 in the furnace heat the interface material 19 which in turn heats the melt 20.

Although the embodiment is shown with a single lance in the center of the furnace the number and location of the lance will vary in relation to the material, surface area and volume of the melt. The lance can even be located in the lining of the furnace itself.

The gas being forced through the porous body 15 produces a large number of small bubbles which are more effective in promoting the chemical action required than the larger bubbles produced by a regular lance would be.

It is not necessary to inject the carbon dioxide at the bottom of the melt as normally would be expected. In all furnaces, and in induction furnaces in particular, there is a constant flow within the melt. This brings fresh metal to any particular point in the bath. By placing the lance only a short distance below the surface of the melt, metal that has not been subjected to the action of carbon dioxide is constantly brought into the vicinity of the lance so that in a very short time the complete bath is effectively subjected to the action of the carbon dioxide. In arc furnaces the movement of the metal is not so great, and in such a case, the lance is placed lower in the melt, moved to different positions in the melt or several lances are used. The bottom of the melt is a convenient place for locating a lance in an arc furnace.

We also find that purging a furnace with $CO_2$ prior to the commencement of melting in an arc furnace reduces the fume caused by arc melting and also prolongs the life of the electrodes (usually carbon) used for this purpose.

In addition the carbon dioxide, being heavier than air, lies on top of the melt excluding air from the melt's surface and thereby providing a sealing barrier against pickup of hydrogen, nitrogen or oxygen from the air.

Our invention reduces the carbon content of a melt without a similar reduction in silicon and manganese and reduces the basic gas content of the melt to a very low value.

As an example of the process of the invention, we produced a melt of medium carbon steel in an induction furnace. The charge consisted of steel scrap containing 0.45% carbon, 0.46% manganese and 0.40% silicon.

After the charge was melted a sample was removed; a porous plug lance as described in FIG. 1 in the specification was immersed in the metal to a depth of about six inches and carbon dioxide gas was injected at the rate of 5 cubic feet per minute per ton of metal for a period of ten minutes at a pressure of approximately 12 psi. The power was left on during this injection period and a vigorous boil resulted.

After the boil was completed, the carbon dioxide gas was turned off and a second test sample was removed from the furnace. The metal was then tapped into a ladle to which 16 ounces per ton of aluminum had been added. A third test sample was removed from the ladle and the metal was then cast. The three test samples taken during this heat were analyzed with the following results:

| Test Sample | % CARBON | % SILICON | % MANGANESE | p.p.m. NITROGEN | p.p.m. HYDROGEN |
|---|---|---|---|---|---|
| #1 | 0.46 | 0.40 | 0.46 | 110 | 22 |
| #2 | 0.39 | 0.41 | 0.45 | 80 | 2 |
| #3 | 0.40 | 0.40 | 0.45 | 78 | 2 |

In another test a steel heat was melted and was boiled with carbon dioxide at a rate of 10 cubic feet per minute per ton of metal for a period of 12 minutes. This metal was deoxidized with 8 ounces per ton of aluminum and a test piece was cast and tested after heat treatment. The heat treatment consisted of annealing at 1750 degrees F., quenching in water and tempering at 1150° F. The physical and chemical properties of this steel were as follows:

| | |
|---|---|
| Carbon | 0.25% |
| Silicon | 0.31% |
| Manganese | 0.57% |
| Chromium | 0.54% |
| Nickel | 0.55% |
| Molybdenum | 0.53% |
| Nitrogen | 70 p.p.m. |
| Hydrogen | 3 p.p.m. |
| Aluminum | .06% |
| Ultimate Strength | 127,250 psi |
| Yield Strength | 87,500 psi |
| Reduction of Area | 46.2% |
| Elongation | 17.5% |
| Hardness | Rc 27.4 |
| Notched Impact at −40° F. | 35.2 |

Figure 4:
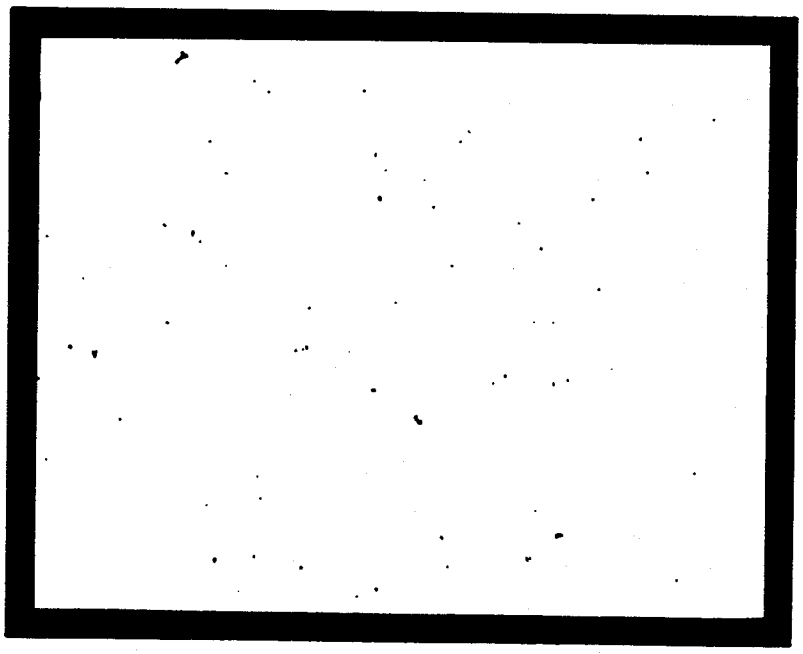
FIG. 4 is a photomicrograph of the steel produced by our invention indicating the relative nature and the amount of the non-metallic inclusions involved.

This steel was exceptionally clean and had a low inclusion count where all inclusions were of the normal type. The residual nonmetallic inclusions, the residual oxides, silicates, etc. are low (FIG. 4).

In practicing the process of our invention, we have found that the injection of carbon dioxide into the furnace cavity, even before melting is conducted, provides a protective atmosphere. In an arc furnace, for example, the presence of carbon dioxide introduced in this matter reduces the amount of fume formed during the melt down process and also appears to decrease the rate of consumption of the carbon electrodes.

It is to be understood that the present disclosure of our invention has been made only by way of example and that numerous changes in the details and the combination and arrangement of the process may be resorted to without departing from the spirit and the scope of the invention has hereinafter claimed.

What is claimed is:

1. An improvement for the process of refining a ferrous metal including the steps of melting the metal and bubbling a gas through the melt to refine the metal, the improvement comprising the gas being carbon dioxide ($CO_2$).

2. The method of refining a ferrous metal containing a conventional amount of readily oxidizable metals which as Si and Mn comprising the steps of superheating the ferrous metal and preventing chemical or oxygen boil in the melt by replacing substantially all of the oxygen in contact with the melt by introducing sufficient $CO_2$ gas into the melt to replace the oxygen which prevents substantial reaction of readily oxidizable metals such as Si and Mn with oxygen with retention of the readily oxidizable metals such as Si and Mn in the melt and while still permitting refining of the melt by reaction of carbon with various oxides to produce carbon monoxide.

3. The method of claim 2 wherein said ferrous metal includes scrap steel.

4. The method of claim 3 wherein said ferrous metal is processed on a continuous basis by removing a portion of the melt, adding additional ferrous metal to said melt with continuous addition of $CO_2$ to the melt and repeating the before recited steps a plurality of times.

5. The method of claim 3 wherein on the order of 50 cubic feet of $CO_2$ is used per ton of metal.

6. The method of claim 4 wherein on the order of 50 cubic feet of $CO_2$ is used per ton of metal.

7. The method of claim 3 characterized by the additional step of deoxidizing the metal with a metal selected from the group consisting of aluminum, magnesium, barium, calcium, zirconium or titanium.

8. The method of claim 4 characterized by the additional step of deoxidizing the melt with a metal selected from the group consisting of aluminum, magnesium, barium, calcium, zirconium or titanium.

9. A process of producing a molten ferrous metal containing an acceptable amount of readily oxidizable metals including silicon and manganese comprising the steps of melting the metal, superheating the molten metal and bubbling $CO_2$ through the molten metal during the superheating period, said carbon dioxide substantially preventing the oxidation of the readily oxidizable metals while allowing a substantially 5–30% reduction in the carbon content.

10. The improved process of claim 9 characterized by the additional step of deoxidizing the melt with a metal selected from the group consisting of aluminum, magnesium, barium, calcium, zirconium or titanium.

11. The improved process of claim 9 characterized by the additional step of removing the dissolved carbon dioxide gas by flushing the melt with an inert gas.

* * * * *